US008227042B2

(12) United States Patent
Sato

(10) Patent No.: US 8,227,042 B2
(45) Date of Patent: Jul. 24, 2012

(54) METHOD FOR PRODUCING WOODEN BOARD

(75) Inventor: Takanori Sato, Makinohara (JP)

(73) Assignee: Ito En, Ltd., Tokyo (JP)

( * ) Notice: Subject to any disclaimer, the term of this patent is extended or adjusted under 35 U.S.C. 154(b) by 451 days.

(21) Appl. No.: 12/448,893

(22) PCT Filed: Jan. 17, 2007

(86) PCT No.: PCT/JP2007/051021
§ 371 (c)(1),
(2), (4) Date: Jul. 14, 2009

(87) PCT Pub. No.: WO2008/087744
PCT Pub. Date: Jul. 24, 2008

(65) Prior Publication Data

US 2010/0047601 A1 Feb. 25, 2010

(51) Int. Cl.
*B05D 3/02* (2006.01)

(52) U.S. Cl. ..... 427/393; 427/397

(58) Field of Classification Search ..... None
See application file for complete search history.

(56) References Cited

FOREIGN PATENT DOCUMENTS

| | | | | |
|---|---|---|---|---|
| JP | 62-001501 | A | | 1/1987 |
| JP | 11-226100 | A | | 8/1999 |
| JP | 2000-212093 | | * | 8/2000 |
| JP | 2001-348968 | A | | 12/2001 |
| JP | 2002-017828 | | * | 1/2002 |
| JP | 2002-321205 | A | | 11/2002 |
| JP | 2004-237496 | A | | 8/2004 |
| JP | 2005-199553 | A | | 7/2005 |
| JP | 2006-112013 | | * | 4/2006 |

OTHER PUBLICATIONS

International Search Report of the International Searching Authority mailed on Apr. 10, 2007 for the corresponding international patent application No. PCT/JP2007/051021 (English translation enclosed).

* cited by examiner

*Primary Examiner* — Erma Cameron
(74) *Attorney, Agent, or Firm* — Posz Law Group, PLC

(57) ABSTRACT

Provided is a method for producing a wooden board in which a functional component such as a green tea polyphenol can be efficiently and stably incorporated into a wooden board, and a wooden board produced using the method. The method is a method for producing a wooden board, including a moisture conditioning step after drying a wood mat obtained by forming a wood raw material, wherein the moisture conditioning is carried out by adding an aqueous solution containing the functional component to the wood mat after drying.

12 Claims, No Drawings

METHOD FOR PRODUCING WOODEN BOARD

CROSS REFERENCE TO RELATED APPLICATION

This application is a U.S. national stage application of PCT/JP2007/051021 filed on Jan. 17, 2007.

TECHNICAL FIELD

The present invention relates to a method for producing a wooden board.

BACKGROUND ART

The health boom in recent years has been accompanied by growing interest in technologies in which tea and tea extracts are incorporated into architectural materials, filters and the like.

For instance, JP 2002-321205 A proposes a method for producing wooden boards having antibacterial activity, by incorporating used tea leaves in a wooden board producing process. With transport costs and other expenses in mind, however, procurement of used tea leaves requires finding a tea drink plant that is located in the vicinity of the wooden board factory. Assuming there is a tea drink plant in the neighborhood of the wooden board factory, it becomes then necessary to coordinate the producing schedule of both facilities, and to invest in equipment for sourcing a single type out of the tea drink residues.

JP 2001-348968 A proposes a method for producing interior architectural materials having the capability of adsorbing hazardous chemical substances, by incorporating tea leaves, or a component contained in tea leaves, into the interior architectural material. This method can conceivably be applied to the producing process of wooden boards, which becomes then a method for producing antibacterial or deodorizing wooden boards containing a green tea polyphenol, by adding the green tea polyphenol, as a component contained in tea leaves, to wood fibers, obtaining thereafter a wood mat by forming, and drying then the wood mat. However, large amounts water are wrung out during obtention of the wood mat through forming of a wood fiber slurry, and thus the green tea polyphenol is lost at the time of forming. Moreover, green tea polyphenols decompose readily on account of the drying temperature. Patent document 2 discloses no detailed tea leave addition amounts and no effective examples. When tea leaves are added thus in the addition amount of the used tea leaves disclosed in Patent document 1 in case of addition of tea leaves in place of a green tea polyphenol, the cost incurred in doing so is problematic, since the weight of the added tea-leaf dry product amounts to about 1 to 5 kg per 1-tatami size (about 1.65 square meters) of insulation board.

Thus, no conventional wooden board production methods are known that allow a green tea polyphenol to be incorporated efficiently and stably in wooden boards.

DISCLOSURE OF THE INVENTION

Therefore, it is an object of the present invention to provide a method for producing a wooden board in which a functional component such as a green tea polyphenol can be efficiently and stably incorporated into the wooden board, and to provide a wooden board produced using the method.

As a result of various studies directed at solving the above problem, the inventors perfected the present invention upon finding that a functional component can be incorporated efficiently and stably into a wooden board by drying a wood mat obtained through forming of a wood raw material, and performing thereafter moisture conditioning by adding an aqueous solution containing the functional component to the wood mat after drying.

Specifically, the present invention provides a wooden board production method and a wooden board, as follows.

(1) A method for producing a wooden board, comprising a moisture conditioning step after drying a wood mat obtained by forming a wood raw material, wherein the moisture conditioning is carried out by adding an aqueous solution containing a functional component to the wood mat after drying.

(2) The method according to (1), wherein the addition amount of the aqueous solution ranges from 7 to 15 wt % of the wood mat after drying.

(3) The method according to (1) or (2), wherein the functional component is a plant extract.

(4) The method according to (3), wherein the plant extract contains a polyphenol.

(5) The method according to (4), wherein the polyphenol is a green tea polyphenol.

(6) The method according to (5), wherein the wooden board is a wooden board having antibacterial activity.

(7) The method according to (5) or (6), wherein the aqueous solution is added to the wood mat after drying, in such a manner that the content of the green tea polyphenol ranges from $3.5\times10^{-3}$ to 1.0 g per 100 g of the wooden board.

(8) The method according to any one of (1) to (7), wherein the wooden board is an insulation board, an MDF (medium density fiberboard), a hardboard or a particleboard.

(9) A wooden board produced using the method according to any one of (1) to (8).

BEST MODE FOR CARRYING OUT THE INVENTION

The wooden board type that is produced in the present invention is not particularly limited, and may be, for instance, a fiberboard such as an insulation board (soft fiberboard), a hardboard (hard fiberboard) or a medium density fiberboard (MDF), or a particleboard. The production method of the present invention is particularly effective for the production of insulation boards or hardboards.

Insulation boards are soft fiberboards having a density less than 0.35 g/cm$^3$ and produced through drying of entangled wood fibers, without heat pressing. The production method of insulation boards may involve, for instance, producing a wood mat by wet forming, which comprises fiber formation by steaming and fiber-opening of the wood raw material, followed by sequential addition of water, a sizing agent and the like. The wood mat is then dried, moisture-conditioned, and finished.

Hardboards are hard fiberboards having a density of 0.8 g/cm$^3$ or greater, produced through a board-forming process that involves forming and heat-pressing of wood fibers. A wet-type hardboard production method may involve, for instance, producing a wood mat by wet forming, which comprises fiber formation by steaming and fiber-opening of the wood raw material, followed by sequential addition of water, a sizing agent and the like. The wood mat is then heat-pressed, moisture-conditioned, and finished. A dry-type hardboard production method may involve, for instance, producing a wood mat by dry forming, which comprises fiber formation by steaming and fiber-opening of the wood raw material, followed by drying and addition of an adhesive agent, a hydrophobizing agent and the like. The wood mat is then heat-pressed, moisture-conditioned, and finished.

MDFs are intermediate fiberboards having a density equal to or more than 0.35 g/cm$^3$ to less than 0.8 g/cm$^3$, produced through a board-forming process that involves forming and heat-pressing of wood fibers. The production method of MDFs may involve, for instance, producing a wood mat through dry forming, which comprises fiber formation by steaming and fiber-opening of the wood raw material, followed by drying and addition of an adhesive agent, a hydrophobizing agent and the like. The wood mat is then heat-pressed, moisture-conditioned, and finished.

Particleboards are produced through high-temperature, high-pressure pressing of small chips of wood. A particleboard production method may involve, for instance, producing a wood mat by dry forming, which comprises cutting/crushing a lumber raw material into small chips, followed by drying and addition of an adhesive agent, a hydrophobizing agent and the like. The wood mat is then heat-pressed, moisture-conditioned, and finished.

All the wooden board production methods comprise thus the steps of obtaining a wood mat by forming a wood raw material, drying then the wood mat (including drying by hot pressing), and conditioning thereafter the moisture of the wood mat.

The wood raw material is not particularly limited, provided that it can be made into a slurry. Examples of the wood raw material include, among others, demolition material (for example, industrial scrap wood, construction scrap wood), low-quality chips, wooden surplus material and forestry surplus material (for example, thinning timber).

The species of tree from which the wood raw material is derived is not particularly limited, and may be, for instance, a conifer such as Japanese cedar, Japanese cypress, hiba cypress, pine or the like; a broad-leaved tree such as chestnut, Japanese white birch, oak, Japanese shii, poplar, willow or the like; or a Southeast Asia tree such as lauan.

Prior to forming, the wood raw material is processed, as the case may require, into a state that allows it to be made into a slurry. Such process may involve, for instance, fiber formation by steaming and fiber opening, as well as chipping (pulverization) by cutting and crushing. Specific examples include, for instance, wood fibers obtained through fiber-opening of wood chips or the like, or wood powder obtained through wood crushing or in the form of sawdust produced in saw mills. Wood fibers and wood powder can be appropriately used mixed with each other. Means for obtaining wood fibers through fiber-opening of wood chips or the like include, for instance, defibrators, hammer mills, ring breakers and the like.

In terms of, for instance, slurry preparation, appearance of the produced wooden boards and penetration of the aqueous solution of green tea polyphenol added into the wood mat, the fiber width of the wood fibers or wood powder is preferably no greater than 0.5 mm. In terms of, for instance, slurry preparation and appearance of the produced wooden boards, the wood fiber length is preferably no greater than 10 mm. The length of the wood powder is preferably no greater than 3 mm. When using excessively fine fibers or powder, the wooden board becomes brittle and it may be necessary to employ a large amount of binder in order to increase the shape-retaining ability of the wooden board.

Forming of the wood raw material can be carried out in accordance with conventional methods. For instance, a wood mat may be obtained by preparing a slurry in which the wood raw material is dispersed in water, followed by draining of the water and forming of the wood raw material. Draining of water from the slurry can be accomplished in the same way as in paper milling, i.e. by feeding the slurry to a filter member such as a mesh or the like, to filter water thereby. The thickness of the wood mat can be adjusted by adjusting the ratio between the filtration surface area and the amount of slurry that is fed.

In production methods of insulation boards, wet-type hardboards and the like, the wood mats obtained by forming are then dried. Drying of the wood mat is preferably carried out uniformly throughout the wood mat in such a manner that the water content immediately after drying is about 0 to less than 5 wt %. The drying temperature ranges ordinarily from 90 to 200° C., preferably from 100 to 180° C. The drying time ranges ordinarily from 3 to 24 hours.

In production methods of dry-type hardboards, MDFs (medium density fiberboards), particleboards or the like, the wood mats obtained by forming are dried by heat-pressing. Drying of the wood mat is preferably carried out uniformly throughout the wood mat in such a manner that the water content immediately after drying is about 0 to less than 5 wt %. The drying temperature ranges ordinarily from 140 to 200° C., preferably from 150 to 180° C. The applied pressure ranges ordinarily from 1 to 10 MPa. The drying time ranges ordinarily from 5 minutes to 2 hours, preferably from 10 minutes to 1 hour.

The moisture of the wood mat after drying is conditioned by adding an aqueous solution containing the functional component to the wood mat after drying. For instance, the aqueous solution containing the functional component can be coated or sprayed onto the wood mat.

Examples of the functional component include, for instance, a plant extract that can impart desired properties to the wood mat. Examples of plant extracts that can impart antibacterial properties include, for instance, tea extracts such as green tea extract, oolong tea extract, black tea extract or the like, as well as persimmon extract, apple peel extract, grape seed extract, cypress extract, Moso bamboo extract, mugwort extract, perilla extract, licorice extract or the like. Polyphenols contained in tea extracts, and among them, green tea polyphenol components, can be obtained for instance from a juice or extract (for example, a water extract) from used tea leaves or green tea leaves, or out of a juice, extract or the like (for instance, a water extract) from the green tea silage set forth in JP 2002-272385 A having residual green tea polyphenols. The green tea that can be used may be, for instance, Sencha (broiled) tea, Bancha (coarse) tea, Gyuokuro (choice green) tea, Tencha (fine ground) tea, Kamairi (pan fired) tea or the like, brewed from tea leaves obtained from the *Camellia* genus (for instance, *C. sinensis* or *C assamica*), a Yabukita variety or hybrids of the foregoing. The green tea polyphenol can be extracted using conventional methods. Examples of green tea polyphenols include, for instance, non-epicatechins such as catechin, gallocatechin, catechin gallate and gallocatechin gallate, and epicatechins such as epicatechin, epigallocatechin, epicatechin gallate and epigallocatechin gallate.

Examples of plant extracts that can impart a capability of capturing organic substances, for instance the capability of capturing formaldehyde, include tea extracts such as green tea extract, oolong tea extract, black tea extract or the like, as well as apple peel extract, grape seed extract and the like. Examples of plant extracts that can impart a deodorizing capability include, for instance, include tea extracts such as green tea extract, oolong tea extract, black tea extract or the like, as well as Japanese cypress extract, Moso bamboo extract and the like.

Moisture may be conditioned at any time after drying of the wood mat, but ordinarily the moisture of the wood mat is adjusted immediately after drying. The addition amount of aqueous solution containing the functional component is preferably adjusted in such a manner that the water content in the wooden board article ranges from 5 to 13 wt %. Specifically, the addition amount of aqueous solution containing the functional component ranges preferably from 7 to 15 wt % of the wood mat after drying. When the water content in the wooden board is less than 5 wt %, the wooden board absorbs moisture from the atmosphere, which renders the dimensions of the wooden board unstable. On the other hand, a water content of 13 wt % or greater leads to dimensional upsetting during water release. The standard JIS A 5905 sets out a water content of 5 to 13 wt % for insulation boards and hardboards.

When the functional component is a green tea polyphenol, the addition amount of aqueous solution containing the green tea polyphenol is preferably adjusted in such a manner that the content of the green tea polyphenol ranges from $3.5\times10^{-3}$ to 1.0 g relative to 100 g of the wooden board. A content of the green tea polyphenol per 100 g of the wooden board less than $3.5\times10^{-3}$ precludes achieving sufficient antibacterial properties. When the content of the green tea polyphenol per 100 g of the wooden board is 3.0 g or greater, the wooden boards stick to each other when piled up, and the quality of the product is poor.

The wood mat after addition of the aqueous solution containing the functional component is preferably left to stand for 12 hours or more, after stacking as the case may require, with a view to allowing the green tea polyphenol aqueous solution to penetrate into the wood mat. When this standing time is less than 12 hours, the component may fail to permeate uniformly throughout the wooden board, which may give rise to unevenness.

The wooden board produced in accordance with the present invention has the functional component incorporated therein in an effective and stable manner, and can hence deliver a superior performance (antibacterial properties when the functional component is green tea polyphenol) vis-à-vis conventional wooden boards.

EXAMPLES

The present invention will be explained next in detail based on examples. The invention, however, is in no way limited to or by the examples.

Examples A1 to 2, Comparative examples Z1 to 6

White paper and water were stirred in a mixer for 5 minutes to prepare a paper fiber slurry having an absolute dry weight ratio of 2 wt %. White paper was used to avoid the influence of the tannin component of wood. The paper fiber slurry was dewatered under application of 300 kg/m$^2$ of pressure, yielding a dewatering liquor in the process. After dewatering, the mat-shaped formed product was dried at 140° C. over 3 hours, and was coated, immediately after drying, with a 3 wt % aqueous solution of a green tea polyphenol (trade name: Theaflan 30A, by Ito En, composition given in Table 1) to a predetermined blending ratio (see Table 2), to prepare catechin-containing insulation boards (Examples A1 to 2). In Table 1, "EGC" denotes epigallocatechin, "EGCg" denotes epigallocatechin gallate, "EC" denotes epicatechin and "ECg" denotes epicatechin gallate.

In parallel, a green tea polyphenol (trade name: Theaflan 30A, by Ito En, composition given in Table 1) was mixed with the paper fiber slurry to predetermined blending ratios (see Table 2). Each resulting mixture was spread evenly over a 100-mesh wire net, to yield a mat-like form. The formed mat was dewatered through application of a 300 kg/m$^2$ pressure, yielding a dewatering liquor in the process. After dewatering, the mat-shaped formed product was dried at 140° C. over 3-hours, to prepare a catechin-containing insulation board (Comparative examples Z1 to 3).

The paper fiber slurry was spread evenly over a 100-mesh wire net, to yield a mat-like form. The formed mat was dewatered through application of a 300 kg/m$^2$ pressure, yielding a dewatering liquor in the process. After dewatering, the mat-shaped formed product was coated with a 3 wt % aqueous solution of a green tea polyphenol (trade name: Theaflan 30A, by Ito En, composition given in Table 1) to a predetermined blending ratio (the addition amount is given in Table 2 as weight range relative to the weight of dry paper fibers) and was dried at 140° C. for 3 hours, to prepare catechin-containing insulation boards (Comparative examples Z4 to 6).

The residual ratio of green tea polyphenol amount in each of the catechin-containing insulation boards was calculated on the basis of the formula below.

$$\text{Residual ratio (\%)}=\{1-(\text{amount of green tea polyphenol in dewatering liquor})/(\text{amount of added green tea polyphenol})\}\times100$$

TABLE 1

| Green tea extract catechins (per dry product) | | | | | |
|---|---|---|---|---|---|
| Total | Catechin | | | | |
| polyphenol | EGC | EGCg | EC | ECg | Total |
| 38% | 10% | 14% | 2% | 4% | 30% |

TABLE 2

| | Example | | Comparative example | | | | | |
|---|---|---|---|---|---|---|---|---|
| | A1 | A2 | Z1 | Z2 | Z3 | Z4 | Z5 | Z6 |
| Component addition before mat formation | — | — | 0.2% | 0.5% | 1.0% | — | — | — |
| Component addition and drying after mat formation | — | — | — | — | — | 0.2% | 0.5% | 1.0% |
| Component addition after mat formation and drying | 0.2% | 0.5% | — | — | — | — | — | — |
| Residual ratio of green tea polyphenol component | 100% | 99% | 21% | 22% | 25% | 46% | 52% | 60% |

As Table 2 shows, when the green tea polyphenol is added before mat formation (Comparative examples Z1 to 3) or after mat formation but before drying (Comparative examples Z4 to 6), the green tea polyphenol ran off and decomposed, and there decreased the residual proportion in the product relative to the added amount. By contrast, addition of the green tea polyphenol after mat formation and drying (Examples A1 to 2) resulted in a significant increase of the residual portion in the product.

Examples B1 to 5, Examples Y1 to 5

Commercially available hardboards (10 boards), cut to 15 cm×15 cm, were dried for 3 hours at 105° C. Thereafter, a predetermined amount (see Table 3) of a green tea polyphenol aqueous solution was sprayed onto each of the 10 boards, which were then stacked. The water content was measured after 1 hour, 6 hours, 12 hours and 24 hours, and the state of the surface was observed.

Observation of the surface state was carried out as follows. The upper and lower backing plates were removed from the 10-board stack one by one, and then the surface of the remaining 8 hardboards was observed and rated in accordance with the method below.

[Evaluation Criteria]

o: no wetting. (Same surface color in the 8 boards)

x: wetting. (Black portions on the surface of one or more boards)

Pass/fail: o pass

Water content was measured as follows. The upper and lower backing plates were removed from the 10-board stack one by one. The change in weight of the remaining 8 boards after drying for 3 hours at 105° C. was measured. The water content was calculated on the basis of the formula below.

$$\text{Water content (\%)}=\{(\text{weight before drying}-\text{weight after drying})/\text{weight before drying}\}\times 100$$

[Evaluation Criteria]

o: water content equal to or more than 5% to less than 13% (JIS A 5905 compliant product)

x: water content 13% or greater, or water content smaller than 5%

Pass/fail: o pass composition given in Table 1) was sprayed on the boards so as to yield a predetermined addition amount (see Table 4), and then the boards were stacked. After being left to stand for 24 hours, the upper and lower backing boards were removed. The samples were subjected to an antibacterial activity evaluation test, and the occurrence of sticking between boards was checked.

The test method for evaluating antibacterial activity was as follows. Hardboard samples were cut to 5 cm×5 cm and were immersed in a 1/500 nutrient broth. Thereafter, the viable count (CFU/plate) of a bacterial suspension (MRSA: methicillin-resistant *Staphylococcus aureus*) of the samples was measured using the film contact method of the Society of Industrial Technology for Antimicrobial Articles.

[Evaluation Criteria]

o: viable count was less than $2.0\times10^3$ after 24 hours.

x: viable count was $2.0\times10^3$ or greater after 24 hours.

Pass/fail: o pass

The criteria for evaluating sticking between boards were as follows.

[Evaluation Criteria]

o: no sticking between boards.

x: sticking between boards

Pass/fail: o pass

TABLE 3

| | Example | | | | | Comparative example | | | | |
|---|---|---|---|---|---|---|---|---|---|---|
| | B1 | B2 | B3 | B4 | B5 | Y1 | Y2 | Y3 | Y4 | Y5 |
| Addition amount | 7% | 8% | 10% | 15% | 15% | 5% | 17% | 15% | 15% | 17% |
| Standing time (hours) | 12 | 12 | 12 | 12 | 24 | 24 | 24 | 1 | 6 | 12 |
| Surface state | ○ | ○ | ○ | ○ | ○ | ○ | X | X | X | X |
| Water content | ○ 5.1% | ○ 5.8% | ○ 7.8% | ○ 12.9% | ○ 12.7% | X 2.6% | X 14.8% | X 13.8% | ○ 12.8% | X 15.3% |

Addition amount: weight ratio relative to board dry weight
Water content: average value for 8 boards As Table 3 shows, it was found that a stable water content could be achieved in the end products when the addition amount of aqueous solution ranged from 7 to 15% relative to the board dry weight, and the time over which water was absorbed by the boards (standing time) was 12 hours or more.

Examples C1 to 6

Commercially available hardboards (8 boards weighing 100 g each) were dried for 3 hours at 120° C., to remove the water component in them. Thereafter, an aqueous solution of a green tea polyphenol (trade name: Theaflan 30A, by Ito En,

TABLE 4

| | C0 | C1 | C2 | C3 | C4 | C5 | C6 |
|---|---|---|---|---|---|---|---|
| Addition amount of green tea polyphenol (per 100 g of dry board) | 0 g | $9.0\times10^{-4}$ g | $3.5\times10^{-3}$ g | $3.5\times10^{-2}$ g | 0.75 g | 1.0 g | 3.0 g |
| Viable count (CFU/plate) | X $8.1\times10^4$ | X $2.0\times10^4$ | ○ $1.5\times10^3$ | ○ <10 | ○ <10 | ○ <10 | ○ <10 |
| Surface state (sticking between boards) | ○ | ○ | ○ | ○ | ○ | ○ | X |

As Table 4 shows, it was found that antibacterial activity and quality stability in the end products are achieved by adjusting the addition amount of green tea polyphenol so as to range from $3.5\times10^{-3}$ to 1.0 g per 100 g of dry wooden board.

Examples D1 to 4, Comparative examples X1 to 4

In the same way as in Examples C1 to 6, commercially available hardboards (8 boards weighing 100 g each) were dried for 3 hours at 120° C., to remove the water component in them. Thereafter, an aqueous solution of a green tea polyphenol (trade name: Theaflan 30A, by Ito En, composition given in Table 1) was sprayed on the boards so as to yield a predetermined addition amount (see Table 5), and then the boards were stacked. After being left to stand for 24 hours, the upper and lower backing boards were removed, and the boards were subjected to an antibacterial activity evaluation test (Examples D1 to 4).

Commercially available hardboards (8 boards weighing 100 g each) were sprayed, without having been dried, with an aqueous solution of a green tea polyphenol (trade name: Theaflan 30A, by Ito En, composition given in Table 1) so as to yield a predetermined addition amount (see Table 5). The boards were then dried for 3 hours at 120° C. After being left to stand for 24 hours, the upper and lower backing boards were removed, and the samples were subjected to an antibacterial activity evaluation test (Comparative examples X1 to 4).

The test method for evaluating antibacterial activity was as follows. Hardboard samples were cut to 5 cm×5 cm and were immersed in a 1/500 nutrient broth. Thereafter, the viable count (CFU/plate) of a bacterial suspension (MRSA: Methicillin-resistant *Staphylococcus aureus*) of the samples was measured using the film contact method of the Society of Industrial Technology for Antimicrobial Articles.

[Evaluation Criteria]

o: viable count was less than $2.0\times10^3$ after 24 hours.

x: viable count was $2.0\times10^3$ or greater after 24 hours.

Pass/fail: o pass

TABLE 5

| | Example | | | | Comparative example | | | |
|---|---|---|---|---|---|---|---|---|
| | D1 | D2 | D3 | D4 | X1 | X2 | X3 | X4 |
| Addition amount of green tea polyphenol (per 100 g of dry board) | $3.5\times10^{-3}$ g | $3.5\times10^{-2}$ g | 0.75 g | 1.0 g | $3.5\times10^{-3}$ g | $3.5\times10^{-2}$ g | 0.75 g | 1.0 g |
| Viable count (CFU/plate) | ○ $1.5\times10^3$ | ○ <10 | ○ <10 | ○ <10 | X $5.2\times10^4$ | X $2.3\times10^4$ | X $1.7\times10^4$ | X $2.0\times10^3$ |

As Table 5 shows, it was found that antibacterial activity can be achieved in the end products by drying commercially available hardboards, removing the water component, and adding thereafter a green tea polyphenol. However, re-drying commercially available boards may be problematic as regards quality stability in the boards themselves, and also in terms of cost.

Industrial Applicability

The present invention provides a method for producing a wooden board in which a green tea polyphenol or the like can be efficiently and stably incorporated into the wooden board, and provides a wooden board produced using the method.

The invention claimed is:

1. A method for producing a wooden board, comprising a moisture conditioning step after drying a wood mat obtained by forming a wood raw material, wherein the wooden board is one of an insulating board or wet-type hardboard and the wooden board has antibacterial activity, and the moisture conditioning step is carried out by adding an aqueous solution containing green tea polyphenol to the wood mat after drying, and an amount of the aqueous solution containing green tea polyphenol added ranges from 7 to 15 wt % of the wood mat after drying.

2. The method according to claim 1, wherein the aqueous solution is added to the wood mat after drying, in such a manner that the content of the green tea polyphenol ranges from $3.5\times10^{-3}$ to 1.0 g per 100 g of the wooden board.

3. An insulating board produced using the method according to claim 1.

4. A wet-type hardboard produced using the method according to claim 1.

5. The method according to claim 1, wherein the aqueous solution is added to the wood mat after drying the wood mat to a water content of 5 wt % or less.

6. A method for producing a wooden board having antibacterial properties, comprising:

preparing an aqueous solution containing raw wood material;

forming a wood mat from the aqueous solution containing raw wood material;

drying the wood mat to a water content of 5 wt % or less; and moisture conditioning the dried wood mat by applying an aqueous conditioning solution to the dried wood mat in an amount of 7 to 15 wt % of the dried wood mat, the aqueous conditioning solution containing an effective amount of green tea polyphenol for imparting antibacterial properties, and maintaining contact between the aqueous conditioning solution and the dried wood mat for a time sufficient for the dried wood mat to absorb the green tea polyphenol in an amount effective for imparting antibacterial properties to the wooden board.

7. The method for producing a wooden board having antibacterial properties according to claim 6, wherein the wooden board is one of an insulating board or wet-type hardboard.

8. The method for producing a wooden board having antibacterial properties according to claim 6, wherein the aqueous conditioning solution is applied to the dried wood mat in an amount where content of the green tea polyphenol in the wooden board ranges from $3.5\times10^{-3}$ to 1.0 g per 100 g of the wooden board.

9. The method for producing a wooden board having antibacterial properties according to claim 6, wherein the maintaining contact between the aqueous conditioning solution and the dried wood mat continues for at least 12 hours.

10. The method for producing a wooden board having antibacterial properties according to claim 6, wherein the maintaining contact between the aqueous conditioning solution and the dried wood mat continues for at least 12 hours and a content of the green tea polyphenol in the wooden board ranges from $3.5\times10^{-3}$ to 1.0 g per 100 g of the wooden board.

11. An insulating board produced using the method according to claim 6.

12. A wet-type hardboard produced using the method according to claim 6.

* * * * *